US007111483B2

(12) United States Patent
King et al.

(10) Patent No.: US 7,111,483 B2
(45) Date of Patent: Sep. 26, 2006

(54) METHOD AND APPARATUS FOR FABRICATING HELICALLY SHAPED RIBBONS OF MATERIAL

(75) Inventors: David King, Troy, IL (US); John Deibert, Highland, IL (US); Gerald Ziolkowski, Edwardsville, IL (US); Jeffrey G. Cotter, Granite City, IL (US)

(73) Assignee: Alco Industries, Granite City, IL (US)

( * ) Notice: Subject to any disclaimer, the term of this patent is extended or adjusted under 35 U.S.C. 154(b) by 353 days.

(21) Appl. No.: 10/666,391

(22) Filed: Sep. 19, 2003

(65) Prior Publication Data

US 2005/0061048 A1 Mar. 24, 2005

(51) Int. Cl.
*B21B 15/02* (2006.01)

(52) U.S. Cl. ..... 72/64; 72/65; 72/299; 72/371

(58) Field of Classification Search ..... 72/64, 72/65, 371, 338, 299
See application file for complete search history.

(56) References Cited

U.S. PATENT DOCUMENTS

| | | | | |
|---|---|---|---|---|
| 3,421,351 A | * | 1/1969 | Doran et al. | 72/64 |
| 3,969,037 A | | 7/1976 | Steiner | |
| 4,137,744 A | | 2/1979 | Smick | |
| 4,367,641 A | * | 1/1983 | Mizutani | 72/65 |
| 4,559,998 A | | 12/1985 | Counterman | |
| 4,601,187 A | * | 7/1986 | Johnson et al. | 72/64 |
| 4,727,907 A | | 3/1988 | Duncan | |
| 4,761,982 A | | 8/1988 | Snyder | |
| 5,107,694 A | * | 4/1992 | Kemp | 72/64 |
| 5,365,891 A | | 11/1994 | Hanning | |
| 5,497,824 A | | 3/1996 | Rouf | |

FOREIGN PATENT DOCUMENTS

JP 63260628 A * 10/1988

OTHER PUBLICATIONS

Metalcraft Machinery—Metal Twister available at: http://www.metal-craft.addr.com/twister.html.
Thermal Dynamics' Design and Manufacturing available at: http://www.thermaldynamics.com/design.html.
BFuel Efficiency, LLC.—Turbulators available at: http://www.fuelefficiencyllc.com/fehxturb.html.
Fin Cool available at: http://www.haydenind.com/swirl.html.
Inner Swirl Turbulator available at: http://www.haydenind.com/design.html.
Exact Exchanger Incorporated—product features available at: http://www.exactexchanger.com/Product_Features/product_features.html.
Metal Roller, Metal Scroller & Metal Twister—Metal Ace Metal-working Machinery available at: http://www.metalace.com.au/scr.html.

* cited by examiner

*Primary Examiner*—Derris H. Banks
*Assistant Examiner*—Teresa M. Bonk
(74) *Attorney, Agent, or Firm*—Armstrong Teasdale LLP

(57) ABSTRACT

Apparatus and methods are utilized to form turbulators. The apparatus includes a first mechanism for accepting a ribbon of material along an axis, a second mechanism for rotating an end of the ribbon of material, and a third mechanism for moving the second mechanism substantially parallel to the axis. The third mechanism is configured to operate independently from the operation of the second mechanism.

19 Claims, 6 Drawing Sheets

METHOD AND APPARATUS FOR FABRICATING HELICALLY SHAPED RIBBONS OF MATERIAL

BACKGROUND OF THE INVENTION

This invention relates generally to methods and apparatus for forming ribbons of material into helixes, and more particularly to methods and apparatus for fabricating multifaceted ribbons of material having a helical configuration.

Heat exchangers sometimes include turbulators to improve heat transfer efficiency. Typically, these turbulators are formed from sheets, or ribbons, of material. The material is cut to a specific length and rotated to form a helical shape. In addition, the twisted ribbon may include facets or bumps to provide better performance. The inclusion of facets onto the turbulators is difficult to automate due to metal working characteristics of the ribbons. In addition, the formation of consistent, symmetrical facets on the ribbons is even more difficult in an automated production due to operation characteristics of the machinery.

BRIEF DESCRIPTION OF THE INVENTION

In one aspect of the invention, an apparatus is provided for manipulating a ribbon of material. The apparatus comprising a first mechanism for accepting the ribbon of material along an axis, a second mechanism for rotating an end of the ribbon of material, and a third mechanism for moving the second mechanism substantially parallel to the axis. The third mechanism is configured to operate independently from the operation of the second mechanism.

In another aspect, a method of fabricating a turbulator utilizing an apparatus is provided. The method comprising engaging a first end of a ribbon of material with a spindle head and moving the first end of the material along an axis, wherein the movement is performed in a first movement pattern. The method also includes rotating the first end of the material about the axis, wherein the rotation is performed in a second movement pattern. The first movement pattern is different from the second movement pattern.

DETAILED DESCRIPTION OF THE INVENTION

Exemplary embodiments of apparatus and methods of fabricating helically shaped ribbons of material are described below. In one embodiment, the helically shaped ribbon of material is a turbulator and the apparatus fabricates the turbulator from a ribbon of material and imparts a plurality of consistent, symmetrical facets to the material.

The apparatus includes a first portion that pulls the material at a varied speed in a direction substantially parallel to the ribbon and a second portion that rotates one end of the material as the material is being pulled. The rotation speed is independent of the speed of the pulling movement.

Although exemplary embodiments are described herein, the apparatus and methods are not limited to those specific embodiments. For example, although apparatus and methods are described for a two ribbon machine, machines that employ more or less than two ribbons of material can also be used. Further, although the initial material is described as a ribbon, other starting materials, such as sheets of material or wire may also be used.

The apparatus and methods are illustrated with reference to the figures wherein similar numbers indicate the same elements in all figures. Such figures are intended to be illustrative rather than limiting and are included herewith to facilitate explanation of an exemplary embodiment of the apparatus and methods of the invention.

Figure 1:
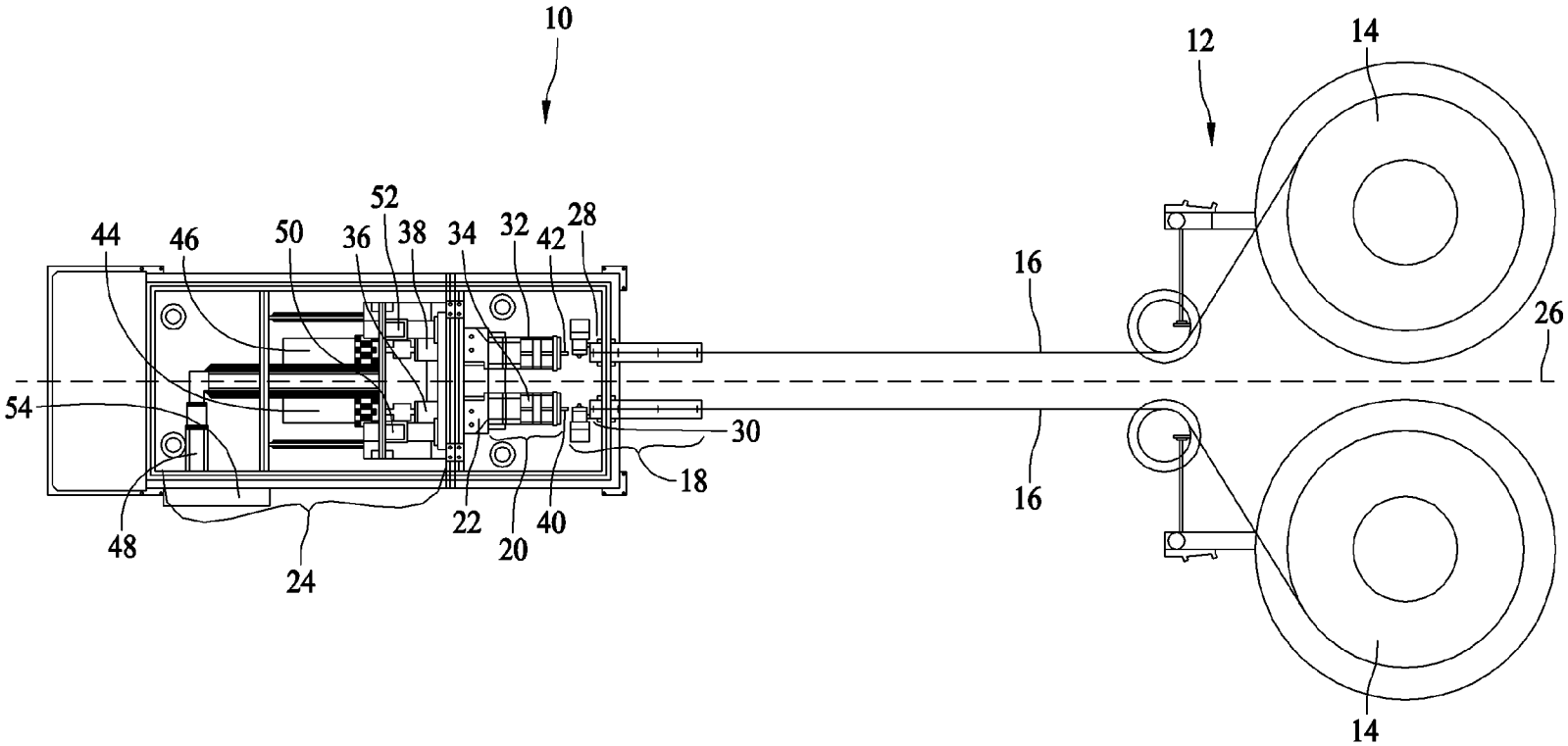
FIG. 1 illustrates a top view of an apparatus and feeding mechanism utilized to fabricate turbulators (not shown in FIG. 1) including an engagement mechanism.

FIG. 1 illustrates a top view of an apparatus 10 utilized to fabricate turbulators (not shown in FIG. 1) and a feeding mechanism 12. Apparatus 10 is configured to manipulate two ribbons of material simultaneously. It should be understood that devices are also contemplated that are able to manipulate only one ribbon of material as well as devices that are able to manipulate more than two ribbons of material. Feeding mechanism 12 includes a pair of feeding spools 14, each holding a ribbon 16 of material. In one embodiment, the material is metal, e.g., steel, aluminum, copper, and other metals. Alternatively, the material is plastic. Apparatus 10 also includes a tensioning device 18 downstream of feeding mechanism 12, and an introducer device 20 downstream of tensioning device 18. A die 22 is located downstream of introducer device 20 and an engagement device 24 is downstream of die 22.

In operation, each ribbon 16 proceeds substantially parallel to an axis 26 of apparatus 10. Ribbon 16 is fed to tensioning mechanism 18 which includes two tensioning devices 28, 30. Each tensioning device 28, 30 is configured to receive a respective ribbon 16. Each ribbon 16 then enters introducer mechanism 20 that includes two introducer devices 32, 34. Each introducer device 32, 34 feeds a respective strand of ribbon 16 to die 22. Die 22 cuts both strands of ribbon 16 to form a first end on each strand of ribbon 16. Each first end of ribbon 16 is fed to an engagement mechanism 24 including a first spindle head 36 and a second spindle head 38. Each spindle head 36, 38 engages the first end of a respective ribbon 16 with a respective pair of jaws 40, 42. Each pair of jaws is connected to a respective air cylinder 44, 46 that opens and closes jaws 40, 42. After engagement of ribbon 16 by spindle heads 36, 38, engagement mechanism 24 moves substantially parallel to axis 26 in a first direction away from die 22 for a first distance. Die 22 then cuts ribbons 16 so the finished product has the correct length. After ribbons 16 have been cut, engagement mechanism 24 again moves in the first direction for a second distance. Engagement mechanism 24 then disengages the cut and formed ribbons and the formed ribbons are released from spindle heads 36, 38. Engagement mechanism 24 then moves in a second direction, opposite the first direction for a distance equal to the sum of the first distance and the second distance to reposition at the engagement position.

Spindle heads 36, 38 are moved parallel to axis 26 by a mechanism including a first servo motor 48. First end of first ribbon 16 is rotated by a mechanism including a second servo motor 50 and first end of second ribbon 16 is rotated by a mechanism including a third servo motor 52. Each servo motor is electrically connected to a controller 54. Controller 54 separately controls the operation of servo motors 48, 50, 52 such that each motor 48, 50, 52 is able to operate at a speed different from the operation speed of either of the other two motors. In one embodiment, controller 46 is an Allen-Bradley controller utilizing a touch screen interface such as a ControlLogix/1756 controller available from Rockwell Automation Corporation, Milwaukee Wis., 53202. Due to the independent operation of servo motors 48, 50, 52, the speed, acceleration, and deceleration at which each ribbon 16 is rotated by spindle heads 36 and 38 can be varied with respect to each ribbon as well as to the speed of movement of engagement mechanism 24 along axis 26. 26.

In one embodiment, controller 54 is programmable to allow the operator to select the slide travel length, slide velocity, slide acceleration/deceleration, and jog slide left/right. Such options enable the operator to custom design turbulators for specific purposes. The customization includes the length of the turbulator, the pitch of the turns of the turbulator, the number, size and consistency of the facets included on the turbulator, and the centering of ribbon 16 in spindle heads 36, 38.

Figure 2:
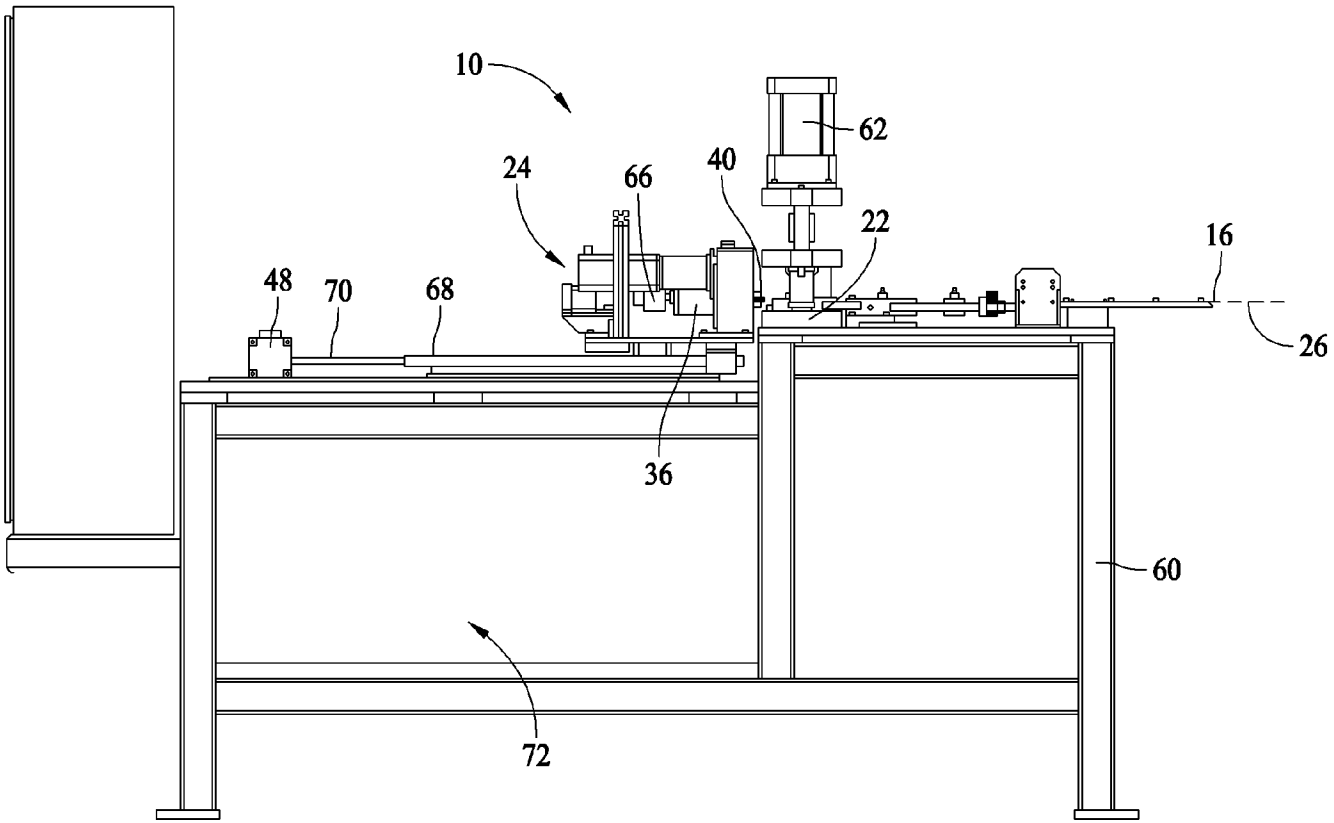
FIG. 2 is a schematic illustration of a side view of the apparatus shown in FIG. 1 mounted to a frame.

FIG. 2 is a schematic illustration of a side view of apparatus 10 mounted to a frame 60. Die 22 is manipulated utilizing a pneumatic cylinder 62 that moves die 22 substantially perpendicular to axis 26. Pneumatic cylinder 62 imparts sufficient pressure to die 22 such that die 22 is able to cut ribbons 16.

Each pair of jaws 40, 42 (only pair of jaws 40 is shown in FIG. 2) engage the first end (not shown) of ribbon 16. Servo motor 50 is connected to a coupling 66 that is connected to spindle head 36 and jaws 40. Spindle head 36 includes appropriate gearing and connections to enable jaws 40 to rotate at the appropriate speeds during movement of spindle heads 36, 38 along transport beam 68. Spindle heads 36, 38 traverse transport beam 68 and are connected to servo motor 48 with a drive unit 70. In one embodiment, drive unit 70 is a belt. In another embodiment, drive unit 70 is a chain. Alternatively, drive unit 70 is a geared mechanism.

Once ribbons 16 are formed into turbulators and cut to the appropriate length, the turbulators, once disengaged by jaws 64, are released and fall into reception cavity 72. In use, a basket, or similar device, is positioned within reception cavity 72 and is utilized to capture and retain the formed, cut turbulators. Part sensors (not shown) are located within apparatus 10 to detect part drop. These sensors activate a counter which counts the number of formed parts.

Figure 3:
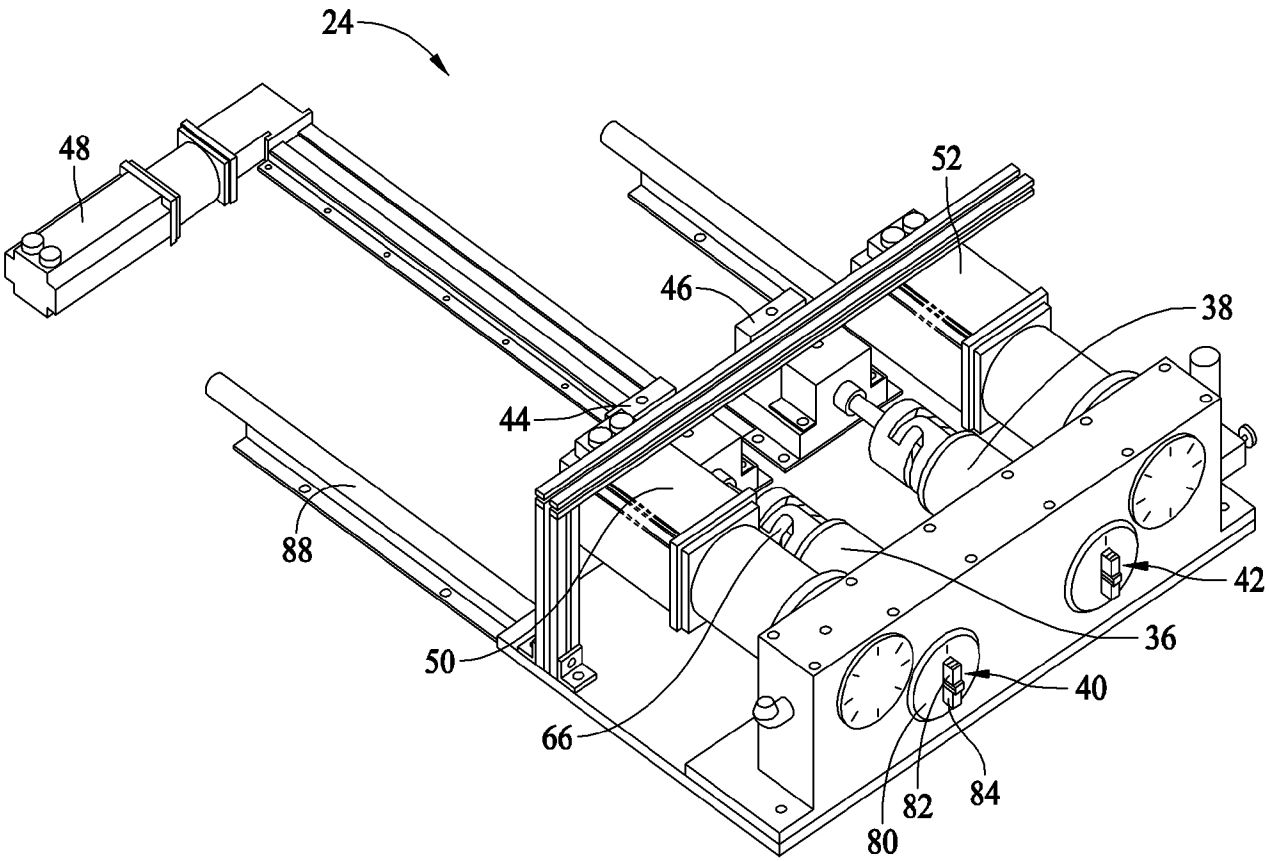
FIG. 3 is a perspective view of the engagement mechanism shown in FIG. 1.
Figure 4:
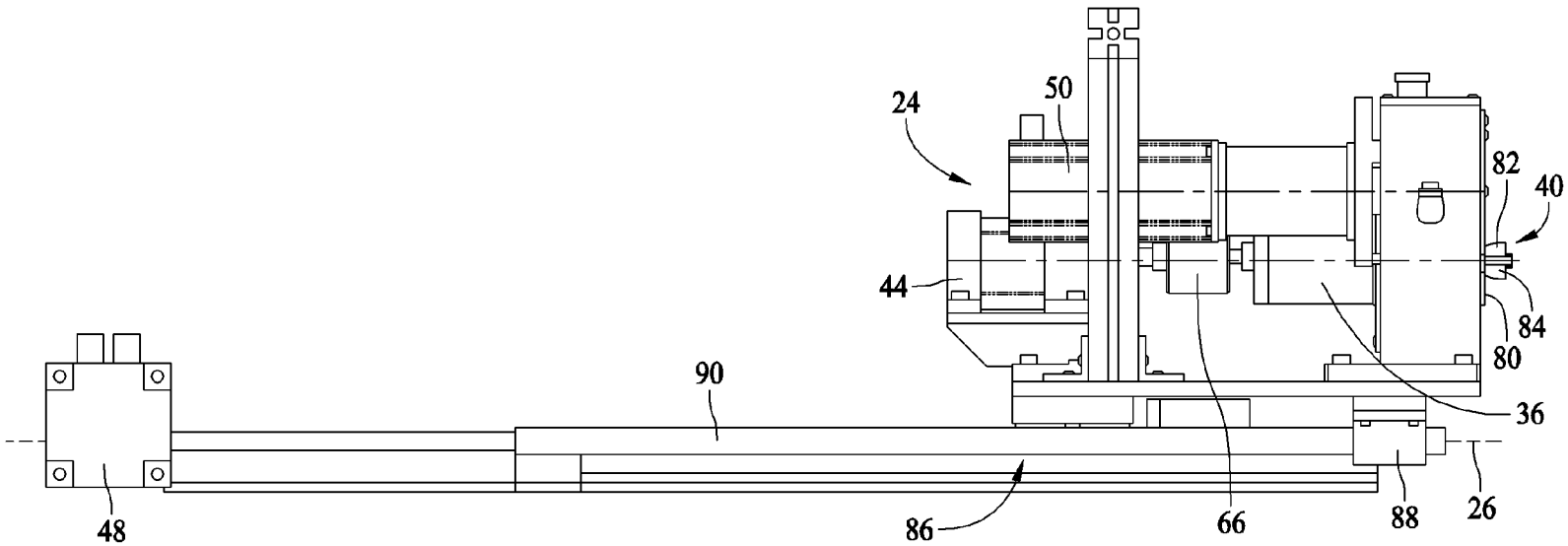
FIG. 4 is a side view of the engagement mechanism shown in FIG. 1.

FIG. 3 is a perspective view and FIG. 4 is a side view of engagement mechanism 24. Each of jaws 40, 42 extends through a respective rotating disk 80 and includes a first member 82 and a second member 84. Rotating disk 80 is fixedly connected to coupling 66. Engagement mechanism 24 further includes a sliding mechanism 86 having a sliding collar 88 that maintains contact with, and travels along a slide rail 90. Slide rail 90 is substantially parallel to axis 26.

Figure 5:
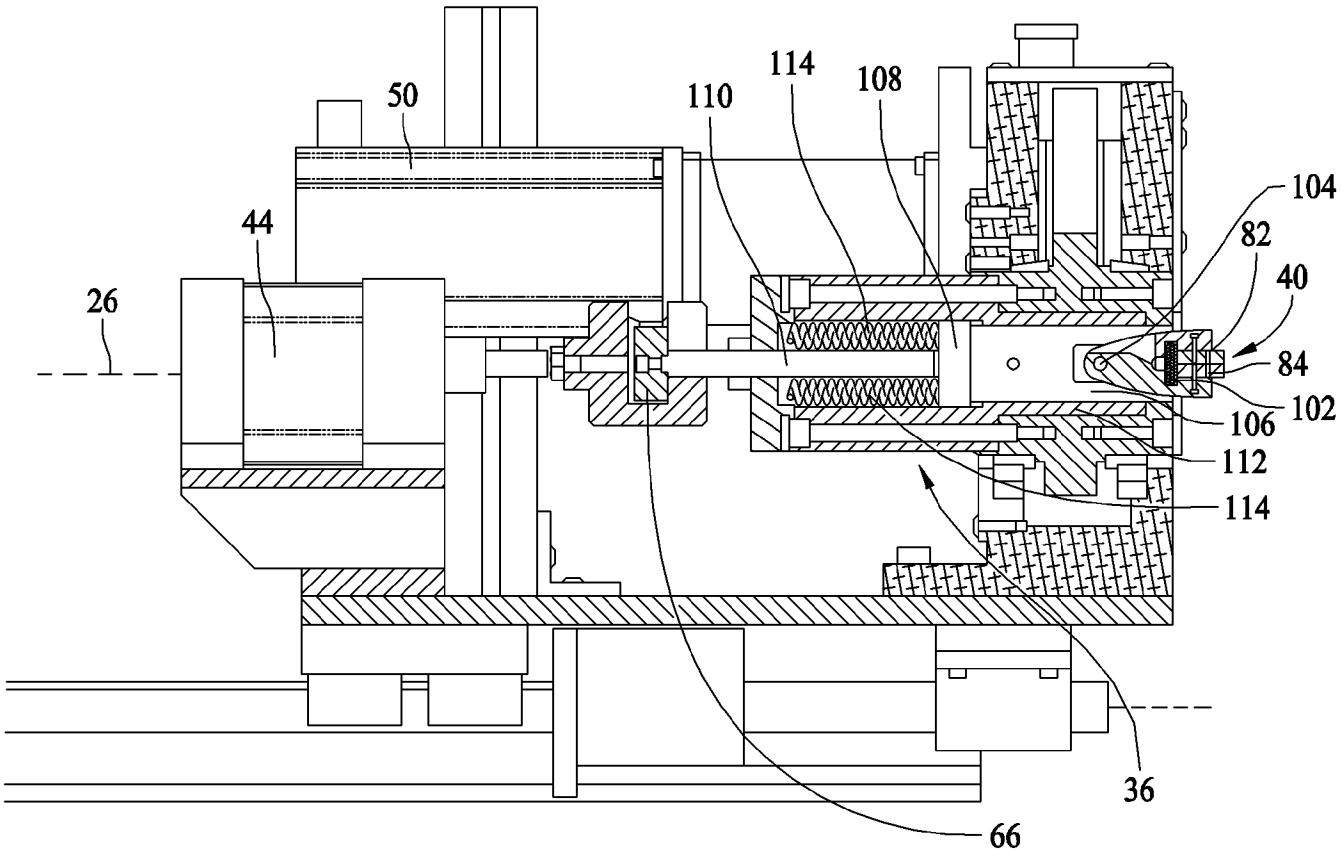
FIG. 5 is a cut away side view of a portion of the engagement mechanism shown in FIG. 1.

FIG. 5 is a cut away side view of a portion of engagement mechanism 24. Jaws 40 include a biasing member 102 and a pivot pin 104. Biasing member 102 biases first member 82 away from second member 84 such that jaws 40 are biased to be in an open position. In one embodiment, biasing member 102 is a compression spring. Spindle head 36 includes a jaw locking portion 106, a piston 108, a piston shaft 110, a housing 112 and at least one biasing member 114. Biasing member 114 biases jaw locking portion 106 to be in the position shown in FIG. 5, i.e., the closed position. Relative movement between jaws 40 and jaw locking portion 106 causes jaws 40 to open and close by allowing first member 82 to move away from second member 84. In an exemplary embodiment, jaw locking portion 106, piston 108 and piston shaft 110 are unitary and are configured to move away from jaws 40. Movement of jaw locking portion 106 away from jaws 40 causes jaws 40 to move away from each other and obtain an open position.

Figure 6:
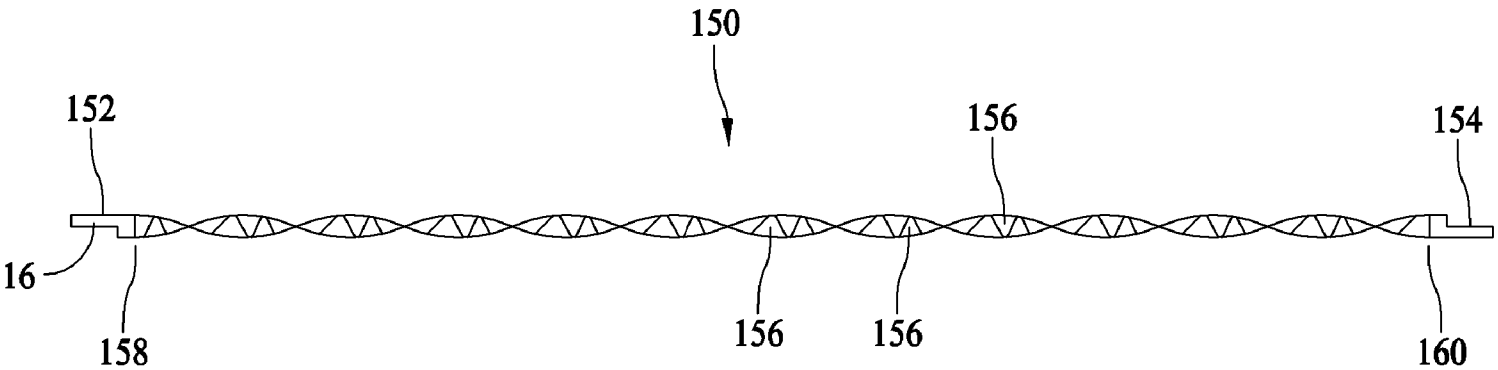
FIG. 6 is a schematic view of a turbulator fabricated utilizing the apparatus shown in FIG. 1.

FIG. 6 is a schematic illustration of a turbulator 150 fabricated utilizing apparatus 10 (shown in FIG. 1). Turbulator 150 includes ribbon 16 having a first end 152, a second end 154 and a helical shape therebetween. In addition, turbulator 150 includes a plurality of facets 156. Facets 156 are triangular in shape and have a consistent size and shape from a facets starting location 158 to a facets ending location 160. The consistency of facets 156 is attributed, at least in part, to the varied speed at which engagement mechanism 24 manipulates ribbon 16.

In a particular embodiment, turbulators 150 are formed by initially moving ribbon 16 at a first speed in a first direction that is parallel to axis 26 to a first position while imparting a pre-twist to the ribbon. At the first position, jaws 40 are rotated at a first rate so that a twist is imparted to ribbon 16 as the ribbon first end traverses along axis 26 at a second speed to a second position. In one embodiment, the second speed is greater than the first speed. At the second position, jaws 40 are rotated at a second rate as ribbon 16 traverses along axis 26 at a third speed to a third position. At the third position, jaws 40 are rotated at a third rate as ribbon 16 traverses along axis 26 at a fourth speed to a fourth position. At the fourth position, a post-twist is imparted to ribbon 16. The post twist is in a direction opposite the direction of the pre-twist and is conducted to relieve the tension from the ribbon such that the ribbon does not create a curl in the last flat. After the post-twist, die 22 cuts ribbon 16 and ribbon 16 is moved along axis 26 to a fifth position at a fifth speed without rotation of jaws 64. The fifth speed is less than the fourth speed. In one embodiment, the second speed, third speed, and fourth speed are the same. In an alternative embodiment, the third speed is less than the second speed and the fourth speed. In a further alternative embodiment, the third speed is greater than the second speed and the fourth speed. In addition, the rotation rate is adjustable independently for each strand of ribbon 16 being manipulated.

The combination of the twist rate and the speed of ribbon along axis 26 is responsible for imparting facets 156 to turbulator 150. The consistency of facets 156 can be varied by altering either or both of the twist rate and the axial speed.

The above described apparatus and methods provide an automated fabrication process for forming turbulators. The process imparts symmetrical and consistent facets during formation of the turbulators. While the invention has been described in terms of various specific embodiments, those skilled in the art will recognize that the invention can be practiced with modification within the spirit and scope of the claims.

What is claimed is:

1. An apparatus for manipulating a ribbon of material, said apparatus comprising:

a spindle head including a pair of jaws engaging a first end of the ribbon of material along an axis;

a first mechanism for moving said spindle head substantially parallel to the axis;

a second mechanism for rotating said pair of jaws about the axis with said first mechanism moving said spindle head substantially parallel to the axis, said second mechanism configured to operate independently from the operation of said first mechanism.

2. An apparatus in accordance with claim 1 wherein the ribbon has a helical shape having a plurality of triangular shaped facets.

3. An apparatus in accordance with claim 2 wherein the plurality of facets are of similar size and shape.

4. An apparatus in accordance with claim 1 wherein the first mechanism is configured to move the spindle head through a first movement phase, the first movement phase including an initial speed, acceleration, deceleration, and an ending speed.

5. An apparatus in accordance with claim 1 further comprising an additional second mechanism such that said apparatus can rotate two strands of ribbon simultaneously.

6. An apparatus in accordance with claim 1 wherein said pair of jaws is configured to accept a metal ribbon.

7. An apparatus in accordance with claim 1 further comprising a die positioned downstream of said second mechanism, said die configured to cut the ribbon.

8. An apparatus in accordance with claim 1 wherein said second mechanism comprises at least one servo motor configured to rotate the ribbon.

9. An apparatus in accordance with claim 1 wherein said first mechanism comprises a servo motor configured to move said spindle head.

10. A method of fabricating a turbulator utilizing an apparatus, said method comprising:

engaging a first end of a ribbon of material with a spindle head;

moving the spindle head engaging the first end of the material along an axis, wherein the movement is performed in a first movement pattern; and rotating the first end of the material about the axis as the spindle head is moved alone the axis, wherein the rotation is performed in a second movement pattern, wherein the first movement pattern is different from the second movement pattern.

11. A method in accordance with claim 10 wherein the rotation is other than constant rotation.

12. A method in accordance with claim 10 wherein the acceleration of the material in the first direction is different from the acceleration of the rotation of the material.

13. A method in accordance with claim 10 further comprising:

cutting the ribbon to form a first cut end; and feeding the first cut end to the spindle head.

14. A method in accordance with claim 13 further comprising cutting the ribbon to form a second cut end.

15. A method in accordance with claim 14 further comprising releasing the cut, formed ribbon.

16. A method in accordance with claim 10 further comprising providing the ribbon to the spindle head with a correct tension.

17. A method in accordance with claim 10 wherein the spindle head includes a pair of jaws, said method further comprising engaging the ribbon with the pair of jaws.

18. A method in accordance with claim 10 wherein the apparatus includes a first servo motor configured to provide axial movement to the material.

19. A method in accordance with claim 18 wherein the apparatus includes a second servo motor configured to rotate the material.

* * * * *